United States Patent [19]

Harvey

[11] 4,023,068

[45] May 10, 1977

[54] ELECTRONIC FLASH APPARATUS FOR CONSERVING FLASH BATTERY LIFE

[75] Inventor: Donald Malcolm Harvey, Webster, N.Y.

[73] Assignee: Eastman Kodak Company, Rochester, N.Y.

[22] Filed: Mar. 15, 1976

[21] Appl. No.: 666,721

[52] U.S. Cl. ..... 315/241 P; 315/360; 320/1; 354/145

[51] Int. Cl.[2] ..... H05B 41/32

[58] Field of Search ..... 315/241 P, 241 R, 151, 315/159, 360; 320/1; 354/127, 137, 145

[56] References Cited

OTHER PUBLICATIONS

B501,503, Mar. 1976, Biber 315/241 P.

*Primary Examiner*—Eugene R. LaRoche
*Attorney, Agent, or Firm*—D. P. Monteith

[57] ABSTRACT

An electronic flash device includes a control circuit for extending the operational life of the flash battery. In one preferred embodiment the flash device is of the type having a monitor circuit responsive to the charge on the flashtube firing capacitor that (1) operably couples the flash battery to a charging circuit when the charge on the firing capacitor is below a predetermined level, and (2) de-couples the battery from the charging circuit when the firing capacitor charge is above the predetermined level. The control circuit comprises a counter for counting the number of times the monitor circuit couples the battery to the charging circuit and for producing a control signal, when the number counted reaches a pre-set value, that overrides the monitor circuit to maintain the battery de-coupled from the charging circuit. In a second preferred embodiment the flash device comprises a time-delay control circuit that de-couples the flash battery from the charging circuit a predetermined interval after the firing capacitor is initially charged to a level adequate to flash the flashtube.

8 Claims, 2 Drawing Figures

ELECTRONIC FLASH APPARATUS FOR CONSERVING FLASH BATTERY LIFE

BACKGROUND OF THE INVENTION

This invention relates generally to a battery powered electronic flash device and, more particularly, to a electronic control circuit for conserving battery power during operational intervals when the flash device is infrequently used.

DESCRIPTION OF THE PRIOR ART

An electronic flash device is flashed when the voltage from a high voltage firing capacitor is discharged through a gas-filled flashtube. To flash the flashtube 250 volts or more may be necessary. Many commercially available flash devices contain a low-voltage battery for charging the firing capacitor. A voltage converter or charging circuit is often utilized to step-up or convert the low voltage of the battery to sufficiently charge the capacitor. Charging circuits of this general type are well known in the art and are described in several publications, one of which is Volume 195 of the Apr. 7, 1975 edition of Research Disclosure entitled Electronic Flash Unit for Cameras Adapted to Receive Flashbulbs, identified in the publication by A1995. Charging circuits continue to draw battery current even after the firing capacitor is fully charged. This wastes battery power and greatly shortens battery life.

Monitor circuits are knwon in the prior art that operate to extend battery life by turning the charging circuit OFF when the firing capacitor reaches full charge. Since the capacitor charge leaks off during intervals when the flash device is not utilized, charge may drop below the level necessary to flash the flashtube. If this occurs, the monitor circuit turns the charging circuit ON to reccharge the firing capacitor. U.S. Pat. Nos. 3,105,170, 3,316,445, and 3,532,961 disclose monitor circuits for maintaining the charging circuit in a standby or OFF condition when the firing capacitor is sufficiently charged.

The charging circuit, of course, darws battery current when the firing capacitor is being charged. Accordingly, over an extended period of time, a significant amount of battery power may be wasted even with a monitor circuit because of the periodic charging of the firing capacitor. A problem encountered with the prior art monitor circuits is that no provision is provided for maintaining the battery de-coupled from the charging circuit if the flash device is not used after a prolonged interval.

SUMMARY OF THE INVENTION

The present invention provides an electronic flash device having a control circuit for maintaining the flash battery de-coupled from a flash charging circuit if the flash device is not fired in a given interval. This circuit therefore reduces unnecessary battery power drain that occurs during extended intervals when the flash ddevice is operational but is not fired.

In accordance with a preferred embodiment of the invention an electronic flash device icludes a charging circuit for charging a flashtube firing capacitor to a level sufficient to fire the flashtube, means for coupling the charging circuit to a source of electrical potential, and monitor means for sensing the charge on the capacitor that (1) automatically de-couples the electrical potential source from the charging circuit when the firing capacitor is adequately charged, and (2) couples the electrical potential source to the charging circuit when the firing capacitor is insufficiently charged. The flash device further includes a control circuit for effectively distabling the monitor means to maintain the flash battery de-coupled from the charging circuit if the electronic flash device is not utilized in a given interval. The conrol circuit comprises counter means for counting the number of times the monitor means de-couples the battery from the charging circuit and for disabling the monitor means when the number counted reaches a preset value. Counter reset means is provided for automatically resetting the counter whenever the flash device is actuated or when a manual switch is actuated.

In another preferred embodiment of the present invention the control circuit comprises a resistance-capacitance timing circuit for de-coupling the battery from the charging circuit a predetermined interval after the firing capacitor is initially charged to a level adequate to flash the flashtube if the flash device is not fired during such interval.

The invention, and its features and advantages will be set forth and become more apparent in the detailed description of the preferred embodiments presented below

BRIEF DESCRIPTION OF THE DRAWING

In a detailed description of the preferred embodiments of the invention presented below, reference is made to the accompanying drawing, in which.

DESCRIPTION OF THE EMBODIMENTS

Because electronic flash devices are well known, the present description will be directed in particular to elements forming part of, or cooperating more directly with, apparatus in accordance with the present invention. It is to be understood that elements not specifically shown or described may take various forms well known to those skilled in the art.

Figure 1:
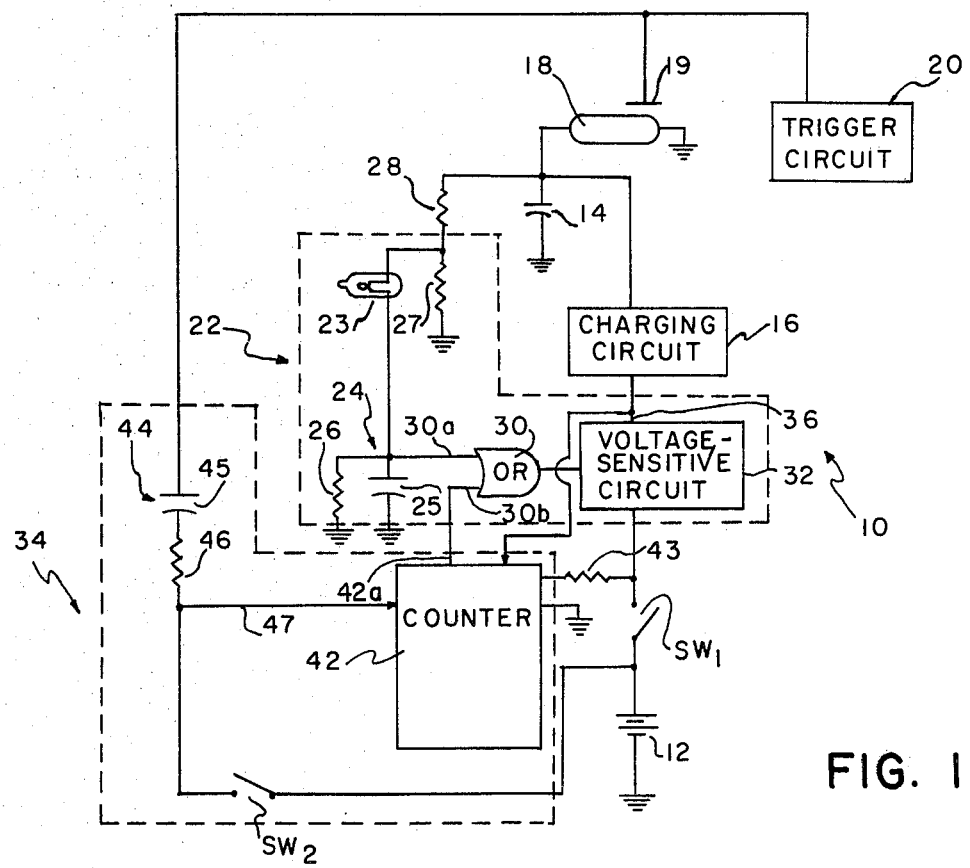
FIG. 1 is a scchematic circuit diagram, partially in block form, of a presently preferred embodiment of the present invention.

There is shown in FIG. 1 an electronic flash device, generally designated 10, comprised of a low voltage battery 12, a flashtube firing capacitor 14, a converter or charging circuit 16 for charging the firing capacitor, a gas-filled flashtube 18 having an external trigger electrode 19, a trigger circuit 20 for supplying a voltage trigger signal to the trigger electrode to initiate ionization of the gas in the flashtube, annd a normally-open control switch SW1 which is closed to apply power from the battery when flash device 10 is mounted in its operational position to be fired.

Switch SW1 may take any of several forms well known to those skilled in the art such as, for example, it may be a manually operated switch or a switch that automatically closes and opens when flash device 10 is mounted on or removed respectively, from a camera (not shown).

Flash device 10 further includes a monitor circuit, generally designated 22, that operates (1) to automatically de-couple battery 12 from charging circuit 16 when firing capacitor 14 is charged sufficiently to fire flashtube 18, and (2) to couple the battery to the charging circuit when the firing capacitor is insufficiently charged. To operate in this manner, monitor circuit 22 includes a voltage-sensitive flash-ready lamp 23 in series with a parallel RC circuit 24 consisting of a capacitor 25 and a discharge resistor 26. Lamp 23 and circuit 24 are shunted across a resistor 27 which is in series with a resistor 28. Resistors 27, 28 constitute a voltage divider circuit in parallel with firing capacitor 14. The resistance values of resistors 27, 28 are selectively controlled such that once firing capacitor 14 is charged to a level sufficient to flash flashtube 18 the voltage at the junction between the two resistors energizes lamp 23 to indicate sufficient capacitor charge to fire flashtube 18. Circuits for indicating the operational status of electronic flash devices are well known in the art and are described in several publications, some of which are the aforementioned Research Disclosure A1995 and U.S. Pat. Nos. 3,105,170, 3,316,445 and 3,532,961.

Monitor circuit 22 further includes a dual-input OR gate 30 and a voltage-sensitive trigger or switching circuit 32. One input 30*a* of the OR gate is connected to the junction between lamp 23 and RC circuit 24 and the second input 30*b* is connected to the output of a control circuit 34 which is described in detail hereinbelow. The input of switching circuit 32 is connected to the output of OR gate 30, and its output 36 is connected to charging circuit 16 as shown. Switcing circuit 32 is of the type known in the art as a Schmitt trigger circuit that has an input that is a normally non-conducting stage, and an output that is a normally conducting stage. When the output of gate 30 conducts, the input of switching circuit 32 conducts and its output 36 simultaneously becomes non-conductive. When this occurs, battery 12 is effectively de-coupled from charging circuit 16 whereby the charging circuit is turned OFF.

It is useful to describe the operation of monitor circuit 22 and the operation of control circuit 34 in terms of an operating cycle. For the purpose of establishing terminology an operating cycle is defined as consisting of a "charging portion" and a "non-charging portion." The charging portion constitutes the interval during which charging circuit 16 charges capacitor 14 to a level at which flash-ready lamp 23 is energized and the non-charging portion constitutes the interval following the charging portion during which charge leaks from capacitor 14 until the capacitor voltage is reduced to a level at which the ready lamp is de-energized to indicate insufficient charge to properly fire flashtube 18.

Monitor circuit 22 operates as follows: During the charging portion lamp 23 is OFF and the output 36 of switching circuit 32 in ON whereby charging circuit 16 is energized to charge firing capacitor 14. Once the latter s charged to a level sufficient to flash the flashtube, the voltage at the junction between resistors 27, 28, which is proportional to the firing capacitor voltage, turns lamp 23 ON. Current flows through lamp 23 to charge capacitor 25. Capacitor 25 charges rapidly to produce a signal at input 30*a*. When that signal reaches a predetermined level, the output of OR gate 30 conducts. When this happens, the input of circuit 32 turns ON and its output 36 turns OFF, whereby the charging circuit is de-energized and no additional charging of firing capacitor 14 occurs. At that instant, the charging portion terminates and the non-charging portion commences.

During the initial interval of the non-charging portion, lamp 23 remains ON. However, during this interval charge gradually leaks from capacitor 14. Eventually, if device 10 is not flashed, the charge on capacitor 14 is reduced to a level at which lamp 23 turns OFF. When this happens, the voltage on capacitor 25 quickly discharges through resistor 26 whereby the output of OR gate 30 is turned OFF. When this occurs, the output 36 of switching circuit 32 turns ON to thereby ennergize charging circuit 16. At that instant, the non-charging portion terminates and the charging portion commences.

In accordance with a preferred emmbodiment of the present invention, control circuit 34 automatically maintains battery 12 de-coupled from charging circuit 16 after a given interval during which flash device 10 is not fired. In doing so circuit 34 includes means for effectively disabling or overriding monitor circuit 22. Accordingly, circuit 34 provides means in addition to monitor circuit 22 for further conserving battery power and lengthening effective battery life.

To achieve this result, circuit 34 includes a resettable counter 42 having its input connected to the normally conducting output 36 of switching circuit 32 and its output 42*a* connected to the input 30*b* of OR gate 30. Resistor 43 provides means by which a signal is applied to bias counter 42 ON. Counter 42 can be pre-set to a required count and operates as follows: Each time output 36 is turned ON, i.e., when the non-charging portion terminates and the charging portion commences, the counter increments its count by one. When the pre-set count has been reached, output 42*a* is turned ON and a signal is applied to input 30*b*. Counter circuits of this general type are known in the art and are described in different publications. One of these publications is U.S. Pat. No. 3,526,181, the disclosure of which is incorporated herein by reference.

The interval monitor circuit 22 operates to permit charging circuit 16 to periodically charge firing capacitor 14 is proportional to the pre-set value at which counter 42 is set. When counter 42 increments its total count to its pre-set value, the output of OR gate 30 is turned ON whereby output 36 of circuit 32 is turned OFF to de-energize charging circuit 16. In effect, counter 42 operates to override monitor circuit 22 by maintaining the output of circuit 34 OFF once the counter counts to its pre-set value, regardless of the state of falsh-ready lamp 23.

Counter 42 may be reset, to return its registered count to zero, either automatically by means of an RC reset circuit 44 consisting of a capacitor 45 in series with a resistor 46, or manually by means of a normally open reset switch SW2. Reset circuit 44 supplies a reset signal via conductor 47 when trigger circuit 20 is actuated to apply a signal to electrode 19 to trigger flashtube 18. Closure of reset switch SW2 permits a reset signal to be applied from battery 12 by means of conductor 47. When counter 42 is reset, output 42*a* is turned OFF. When this occurs, monitor circuit 22 is enabled to permit periodic charging of capacitor 14 in accordance with the state of flash-ready lamp 23.

Accordingly, it shall be obvious to those skilled in the art that control circuit 34 limits the number of operating cycles, with associated drain on battery 12, of flash device 10. In doing so control circuit 34 conserves battery power since once monitor circuit 22 is overridden, the current drained from battery 12 is a small, quiescent current required to energize the input stage of trigger circuit 32 and to bias counter 42 ON. This quiescent current is much less than the current necessary to charge capacitor 14 as the result of battery 12 being periodically coupled to charging circuit 16.

Figure 2:
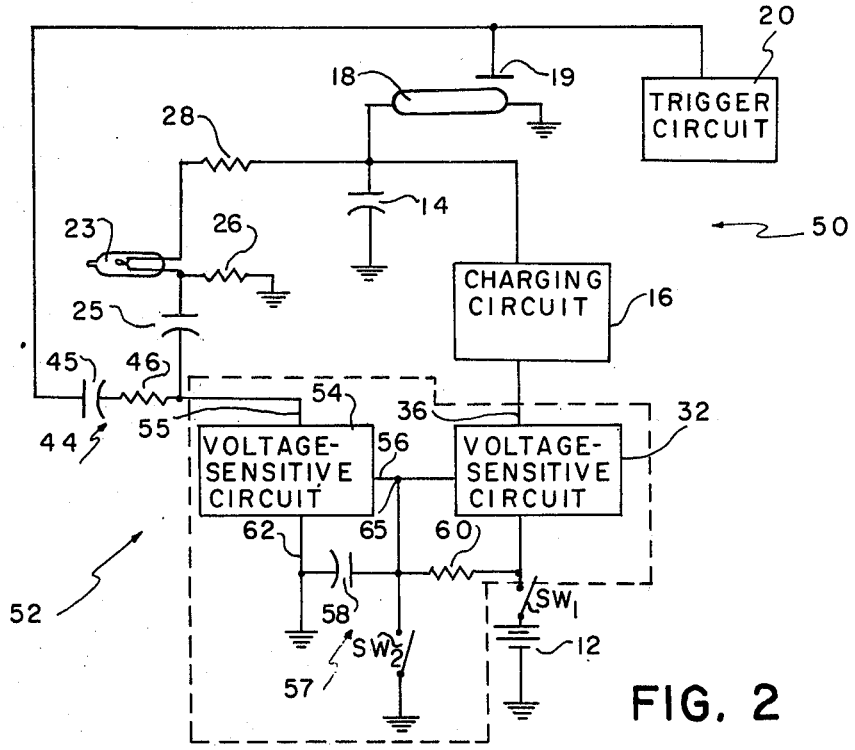
FIG. 2 is a schematic circuit diagram, partially in block form, of a second presently preferred embodiment of the present invention.

Referring now to FIG. 2, there is shown a flash device 50 that includes another preferred embodiment of a control circuit, generally designated 52, that lengthens effective battery life by de-coupling battery 12 from charging circuit 16 after a predetermined interval during which flash device 50 is not utilized. Components and circuits previously described in connection with the embodiment shown in FIG. 1 are identified by the same numeral used in FIG. 1. Control circuit 52 includes switching circuit 32, a voltage-sensitive switching circuit 54 having a normally conducting input stage 55 connected to the junction between capacitor 25 and reset circuit 44, andd a normally non-conducting output 56 connected in parallel with a timing capacitor 58 which is part of an RC delay circuit 57 comprising the timing capacitor 58 in series with a resistor 60.

Voltage-sensitive circuit 54 includes a normally conducting path from its input 55 to conductor 62 while the path from its output 56 to conductor 62 is normally opened. When the amplitude of the signal at input 55 exceeds a predetermined level, circuit 54 switches such that the path from its input 55 to conductor 62 becomes non-conducting and the path from output 56 to conductor 62 conducts. This switching operation occurs either (1) when flash-ready lamp 23 is initially turned ON and capacitor 25 commences to charge, or (2) when current flows through reset circuit 44 as the result of the energization of trigger circuit 20.

As shown, the junction between resistor 60 and capacitor 58 is connected to the junction between switching circuits 32, 54 and one terminal of reset switch SW2. As long as the voltage on capacitor 58 is less than a predetermined amount, the output 36 of circuit 32 is ON and charging circuit 16 charges firing capacitor 14. The resistance and capacitance values of resistor 60 and capacitor 58 are selectively controlled so that the time constant of RC circuit 57 corresponds to the interval that charging circuit 16 may be energized by battery 12 to charge capacitor 14 without flash device 10 being utilized. The time constant of RC circuit 57 is long relative to the time necessary to charge capacitor 14 so the firing capacitor will always be fully charged prior to the voltage at junction 65 becoming sufficient to cause the output of circuit 32 to turn OFF.

In operation, closure of switch SW1 energizes flash device 50. Charging circuit 16 charges capacitor 14. Capacitor 58 is also charged, but at a slower rate, through resistor 60. Once capacitor 16 is charged to a level sufficient to flash flashtube 18, lamp 23 is turned ON and capacitor 25 begins to rapidly charge. As capacitor 25 commences to charge, its charging signal is simultaneously applied to input 55 to establish the aforementioned electrically conducting path from output 56 to conductor 62. Accordingly, any charge on capacitor 58, accumulated during the period firing capacitor 14 is charged, discharges through switching circuit 54. Once capacitor 25 is fully charged, the capacitor blocks any further signal through lamp 23 from being applied to input 55. This permits capacitor 58 to commence charging to a full charge in timed relation to the occurrence of a full charge on firing capacitor 14. The charge on capacitor 58 will gradually rise until the aforementioned predetermined amount is reached. At that time the output of switching circuit 32 is turned OFF. When this occurs, battery 12 is de-coupled from charging circuit 16 to thereby prevent further battery drain due to the charging of capacitor 14. Thus, it can be seen that the time constant of RC delay circuit 57 determines the time that battery 12 is coupled to charging circuit 16 when flash device 50 is operational but is not utilized.

The invention has been described in detail with particular reference to preferred embodiments thereof, but it will be understood that variations and modifications can be effected within the spirit and scope of the invention.

I claim:

1. In an improved electronic flash unit of the type including a flashtube having (1) a normal non-conductive state and (2) a conductive state, a flashtube firing capacitor for storing an electrical potential to render said flashtube conductive, means for charging said firing capacitor, and monitor means responsive to the charge on said firing capacitor (1) for operably coupling a source of electrical potential to said firing capacitor when the charge on said firing capacitor is below a predetermined level and (2) for effectively de-coupling such electrical potential source from said charging means when the charge on said firing capacitor is above said predetermined level, the improvement comprising:

means for automatically disabling said monitor means after a time interval during which said flashtube is maintained in its non-conductive state.

2. In an improved electronic flash unit of the type including a flashtube having (1) a normal non-conductive state and (2) a conductive state, a flashtube firing capacitor for applying an electrical potential to said flashtube to render saidd flashtube conductive, means for charging said firing capacitor, and monitor means responsive to the charge on said firing capacitor (1) for operably coupling said firing capacitor charging means to a source of electrical potential when the charge on said firing capacitor is below a predetermined level and (2) for de-coupling said firing capacitor charging means from the electrical potential source when the charge on said firing capacitor is above said predetermined level, the improvement comprising:

means for automatically preventing said monitor means from coupling said capacitor charging means to the electrical potential source after a time interval during which said flashtube remains in its non-conductive state.

3. In an improved electronic flash unit of the type including a flashtube having (1) a normal non-conductive state and (2) a conductive state, a flashtube firing capacitor for applying an electrical potential to said flashtube to render said flashtube conductive, means for charging said firing capacitor, means for coupling said capacitor charging means to a source of electricl potential to enable said firins capacitor to be charged, and monitor means responsive to the charge on said firing capacitor (1) for operably coupling said firing capacitor charging means to the electrical potential source when the charge on said firing capacitor is below a predetermined level and (2) for de-couping said firing capacitor charging means from the electrical potential source when the charge on said firing capacitor is above said predetermined level, the improvement comprising:

a. means for counting the number of times said monitor means couples said firing capacitor charging means to the electrical potential source; and b. means controlled by said counting means when said counting means reaches a given count value for effectively overriding said monitor means to prevent said capacitor charging means from being coupled to the electrical potential source.

4. In an improved electronic flash unit of the type including a flashtube having (1) a normal non-conductive state and (2) a conductive state, a flashtube firing capacitor for applying an electrical potential to said flashtube to render said flashtube conductive, means for charging said firing capacitor, means for coupling said capacitor charging means to a source of electrical potential to enable said firing capacitor to be charged, and monitor means responsive to the charge on said firing capacitor (1) for operably coupling said firing capacitor charging means to the electrical potential source when the charge on said firing capacitor is below a predetermined level and (2) for de-coupling said firing capacitor charging means from the electrical potential source when the charge on said firing capacitor is above said predetermined level, the improvement comprising:

a. means for counting the number of times said monitor means couples said firing capacitor charging means to the electrical potential source;

b. means controlled by said counting means when said counting means reaches a given count value for effectively overriding said monitor means to prevent said capacitor charging means from being coupled to the electrical potential source; and c. means for resetting said counting means in response to said flashtube assuming said conductive state.

5. In an improved electronic flash unit of the type including a flashtube having (1) a normal non-conductive state and (2) a conductive state, a flashtube firing capacitor for applying an electrical potential to sid flashtube to render said flashtube conductive, means for charging said firing capacitor, means for coupling said capacitor charging means to a source of electrical potential to enable said firing capacitor to be charged, and monitor means responsive to the charge on said firing capacitor (1) for operably coupling said firing capacitor charging means to the electrical potential source when the charge on said firing capacitor is below a predetermined level and (2) for de-coupling said firing capacitor charging means from the electrical potential source when the charge on said firing capacitor is above said predetermined level, the improvement comprising:

a. means for counting the number of times said monitor means couples said firing capacitor charging means to the electrical potential source;

b. means controlled by said counting means when said counting means reaches a given count value for effectively overriding said monitor means to prevent said capacitor charging means from being coupled to the electrical potential source; and c. actuatable switch means for resetting said counting means independent of the count value of said counting means.

6. In an improved electronic flash unit of the type including a flashtube having (1) a normal non-conductive state and (2) a conductive state, a flashtube firing capacitor for applying an electrical potential to said flashtube to render said flashtube conductive, means for charging said firing capacitor, and means for coupling said capacitor charging means to a source of electrical potential to enable said firing capacitor to be charged, the improvement comprising:

a. circuit means for producing a time-delay signal a predetermined time interval after the charge on said firing capacitor reaches a predetermined level; and b. means responsive to said time-delay signal for effectively de-coupling said capacitor charging means from the electrical potential source.

7. In an improved electronic flash unit including a flashtube having (1) a normal non-conductive state and (2) a conductive state, a trigger circuit for applying a trigger signal to said flashtube, a flashtube firing capacitor for applying a discharge signal to said flashtube in response to the occurrence of said trigger signal to render said flashtube conductive, means for charging said firing capacitor, the improvement comprising:

a. switch means having (1) a normal first state for coupling said capacitor charging means to a source of electrical potential to enable said firing capacitor to be charged, and (2) an energizable second state for effectively de-coupling said charging means from the electrical potential source;

b. circuit means for producing a time-delay signal a predetermined time interval after the charge on said firing capacitor reaches a predetermined level;

c. means for applying said time-delay signal to said switch means to switch said switch means into its second state; and d. means responsive to said trigger signal for applying a control signal to said circuit means to prevent the occurrence of said time-delay signal.

8. In an improved electronic flash unit of the type including a flashtube having (1) a normal non-conductive state and (2) a conductive state, a flashtube firing capacitor for applying an electrical potential to said flashtube to render said flashtube conductive, means for charging said firing capacitor, and means for coupling said capacitor charging means to a source of electrical potential to enable said firing capacitor to be charged, the improvement comprising:

a. circuit means for producing a control signal a predetermined time interval after the charge on said firing capacitor reaches a predetermined level;

b. means responsive to said control signal for effectively de-coupling said capacitor charging means from the electrical potential source; and c. means for initiating operation of said circuit means in timed relation with said firing capacitor being charged to said predetermined level.

* * * * *

UNITED STATES PATENT OFFICE

CERTIFICATE OF CORRECTION

Patent No. 4,023,068 Dated May 10, 1977

Inventor(s) Donald Malcolm Harvey

It is certified that error appears in the above-identified patent and that said Letters Patent are hereby corrected as shown below:

| | |
|---|---|
| Column 1, line 7 | Please delete "a" and substitute therefor --an--. |
| Column 1, line 30 | Please delete "knwon" and substitute therefor --known--. |
| Column 1, line 37 | Please delete "reccharge" and substitute therefor --recharge--. |
| Column 1, line 42 | Please delete "darws" and substitute therefor --draws--. |
| Column 1, line 59 | Please delete "ddevice" and substitute therefor --device--. |
| Column 1, line 62 | Please delete "icludes" and substitute therefor --includes--. |
| Column 2, line 5 | Please delete "distabling" and substitute therefor --disabling--. |
| Column 2, line 31 | Please delete "scchematic" and substitute therefor --schematic--. |
| Column 2, line 53 | Please delete "annd" and substitute therefor --and--. |
| Column 3, line 53 | Please delete "s" and substitute therfor -- is --. |
| Column 4, line 10 | Please delete "emmbodiment" and substitute therefor --embodiment--. |

UNITED STATES PATENT OFFICE

CERTIFICATE OF CORRECTION

Patent No. 4,023,068 Dated May 10, 1977

Inventor(s) Donald Malcolm Harvey

It is certified that error appears in the above-identified patent and that said Letters Patent are hereby corrected as shown below:

| | |
|---|---|
| Column 4, line 46 | Please delete "falsh" and substitute therefor --flash--. |
| Column 5, line 15 | Please delete "andd" and substitute therefor --and--. |
| Column 6, line 33 | Please delete "saidd" and substitute therefor --said--. |
| Column 6, line 55 therefor | Please delete "electricl" and substitute --electrical--. |
| Column 6, line 56 therefor | Please delete "firins" and substitute --firing--. |
| Column 7, line 39 | Please delete "sid" and substitute therefor --said--. |
| Column 2, line 8 therefor | Please delete "conrol" and substitute --control--. |
| Column 3, line 27 therefor | Please delete "Switcing" and substitute --Switching--. |
| Column 4, line 7 therefor | Please delete "ennergize" and substitute --energize--. |

UNITED STATES PATENT OFFICE

CERTIFICATE OF CORRECTION

Patent No. 4,023,068 Dated May 10, 1977

Inventor(s) Donald Malcolm Harvey Page 3 of 3

It is certified that error appears in the above-identified patent and that said Letters Patent are hereby corrected as shown below:

Column 6, line 61 Please delete "de-couping" and substitute therefor -- de-coupling --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*